US006120210A

United States Patent [19]

Hsu

[11] Patent Number: 6,120,210

[45] Date of Patent: Sep. 19, 2000

[54] USE OF POROUS MEDIUM IN AN INTEGRATED HYDROLOGIC CIRCUIT FOR WATER STORAGE AND TRANSPORT IN LAND RECLAMATION, AGRICULTURE, AND URBAN CONSUMPTIONS

[76] Inventor: Kenneth J. Hsu, Frohburgstrasse 96, 8006 Zurich, Switzerland

[21] Appl. No.: 09/123,609

[22] Filed: Jul. 28, 1998

[51] Int. Cl.[7] ..... F02B 11/00

[52] U.S. Cl. ..... 405/50; 405/36

[58] Field of Search ..... 405/36, 37, 38, 405/39, 43, 44, 45, 46, 47, 50, 51, 53, 55

[56] References Cited

U.S. PATENT DOCUMENTS

| | | | |
|---|---|---|---|
| 302,322 | 7/1884 | Cole | 405/50 |
| 2,850,843 | 9/1958 | MarBury | 405/36 |
| 3,302,408 | 2/1967 | Schmid | 405/44 |
| 3,336,755 | 8/1967 | Renfro | 405/50 |
| 3,408,818 | 11/1968 | Hemphill | 405/50 |
| 3,685,298 | 8/1972 | Takanashi . | |
| 4,060,991 | 12/1977 | Reese | 405/36 |

FOREIGN PATENT DOCUMENTS

| | | |
|---|---|---|
| 2604737 | 8/1988 | European Pat. Off. . |
| 770735 | 5/1997 | European Pat. Off. . |
| 2727956 | 1/1979 | Germany . |
| 8-260553 | 10/1996 | Japan . |
| 9-47605 | 2/1997 | Japan . |
| 71556 | 7/1980 | Portugal . |
| 2001512 | 2/1979 | United Kingdom . |
| 2682410 | 4/1993 | WIPO . |

*Primary Examiner*—David Bagnell
*Assistant Examiner*—Frederick L. Lagman
*Attorney, Agent, or Firm*—Helfgott & Karas, P.C.

[57] ABSTRACT

A method for providing storage and transportation for water such as natural precipitation collected from a large area comprising the steps of moving water through a porous medium contained within a natural conduit under a hydrologic potential such that the porous medium reduces evaporative loss of the water during storage and transport and moving the water through a network of a hydrologic circuit where it can be directly supplied to end users.

2 Claims, 2 Drawing Sheets

USE OF POROUS MEDIUM IN AN INTEGRATED HYDROLOGIC CIRCUIT FOR WATER STORAGE AND TRANSPORT IN LAND RECLAMATION, AGRICULTURE, AND URBAN CONSUMPTIONS

SUMMARY

Water is a precious commodity for life, and is becoming increasingly precious when the world's population growth places ever greater demand on food production. Desert land is not cultivated because there is a lack of water. Economic considerations encourage water conservation even in humid regions of the world. The most common hydrologic system is a surface-system of reservoir lakes for water storage and canals for water transport. In arid countries, underground hydrologic systems of underground cisterns and tunnels are constructed. This invention is a system for underground water-storage and transport by natural and artificially constructed aquifers.

Integrated hydrologic circuits can be built by modifying natural drainage systems. Such a circuit to store enough water to turn desert land into green oases of human habitation, or to provide water-supply for urban consumptions. Integrated hydrologic circuits can also be built by constructing storage pits and transport canals filled by a porous medium such as sand, gravels, or plastics.

BACKGROUND OF INVENTION

A hydrologic circuit for water-flow is comparable to an electric circuit for the flow of electrons (or conductance of electricity). The circuit consists of various arrangements of resistors, capacitors, and conductors. The resistors in a hydrologic circuit are various forms of hindrances are narrows, sluices, dams or other forms of constrictions that slow down, or prevent altogether, the movement of groundwater. The capacitors are various kinds of natural or man-made water-reservoirs, in which water is stored, and discharge or leakage can be reduced to a minimum by insulation. The conductors are open channels for surface flow (river), underground tunnels for subsurface flow (subterranean river), or channelized flow in a porous and permeable medium (groundwater).

The current practices of constructing hydrologic circuits, such as irrigation systems, has one major disadvantage, much of the water is lost by evaporation during storage in reservoir lakes and during transport in open channels. Furthermore, much water is lost by evaporation when it is fed to soil for plant-growth, and such evaporative loss in agricultural use has led to salinization of soil. A hydrologic circuit exposing water directly to evaporation is comparable to an electric circuit without insulation. To remedy the situation and to reduce or completely prevent evaporative loss, underground systems of underground cisterns and tunnels are constructed. Those systems have been constructed, for example, in arid regions of Middle East, Northwest China, and South America. On a smaller scale, networks of pipes and tubing have been invented, and water is directly fed to where it is needed for plant growth, or for other purposes, with a minimum of loss during transport.

The underground systems of cisterns and tunnels and the manufactured systems of pipes and tubing are costly. The present invention contemplates an alternative system, called the integrated hydrologic circuit (IHC), of water reservoirs and canals which are filled by a porous medium, such as sand or gravel or plastic, so that water is stored and transported in a porous medium. The IHC can be built in humid as well as in arid regions. The essence of the invention is 1a) to build a facility for water-storage in a porous medium, 1b) to enlarge the storage capacity of the porous medium of a natural system, such as a valley stream, 2) make use of, or to construct various forms of insulation against evaporative loss, including the use of a layer of porous medium as insulation in the construction of hydrologic circuits for groundwater flow during the storage, transport, and consumption of water.

Through novel designs of the paths of groundwater flow, the supply and demand can be balanced, and the rate of flow can be adjusted using Darcy's Law.

Water Transport in Porous Medium

Sedimentary rocks and loose debris are more or less porous whereas crystalline rocks such as granites or schists are for practical purposes not porous. Unconsolidated debris, sediment, and soil have a porosity up to 40%. There is pore space between mineral grains and underground water is store in this pore space.

The groundwater table is the surface separating the so-called saturated (phreatic) and unsaturated (vadose) zone of subsurface waters. The pore space in a porous medium of the saturated zone below the groundwater table is completely filled by water. The pore space in a porous medium of the unsaturated zone is filled partly by water and partly by air. Water in the porous medium of the saturated zone can be drained into storage reservoir or pumped out of a water-well.

Sedimentary rocks and loose earth materials are more or less permeable, whereas crystalline rocks such as granites or schists are for practical purposes impermeable. The permeability of a porous medium is a function of the pore-size, and the pore size in detrital sediments is related to the grain-size of the detrus. Coarse sand and gravel are very permeable, having a permeability measured in the hundreds or thousands of darcies. Mud or fine clay which may have just as high porosity as the coarse detritus are not very permeability, having a permeability many orders of magnitude smaller. The difference led to the use of such common expressions: aquifers are layers of sands or gravels which are the main conduits of groundwater flow and aquicludes are layers of clays, muds, shales, or other impermeable rock that tends to obstruct the groundwater movement.

Underground, water below the groundwater-table moves according to Darcy's law as electricity moves according to Ohm's law.

Ohm's law states $$I=E/R \tag{1}$$

Where I is the electric current, E is the electric potential, and R is the resistance.

Darcy law states:

$$Q=k\ (dh/dl) \tag{2}$$

Where k is permeability of the porous medium, dh the height different of water in porous medium, and dl the length of the flow path, and Q the quantity of the water flow.

Water molecules in a saturated zone moves under a hydrologic potential (E=dh/dl) like electrons under an electric potential (E): the greater the pressure difference (or height difference) the greater the potential for movement. The resistance to water flow (R=1/k) is the inverse of the permeability: a more permeable sediment or rock is less resistant to water flow.

Rearranging the Equation (2) and substituting E for (dh/dl), the hydrologic potential, and R for 1/k, the resistance to water flow, we can see the similarity between equations (1) and (2).

$$Q=E/R \quad (2)$$

In other words, one can construct a hydrologic system or integrated hydrologic circuit (IHC) like one constructs an integrated electric circuit (IC). The quantity of water-flow can be systematically adjusted through the variable hydrologic potential and the variable hydrologic resistance.

In using a porous medium as a transport conduit, sand- or gravel-filled channels are constructed. In adjusting the hydrologic potential between two points, the height difference (dh) is fixed but the potential can be reduced by varying the length (dl) of the flow path so as to minimize the flow rate. The two types of hydrologic systems "helminthoid" and "paleodyctin" make use of their different geometry to control the height difference between two points.

Insulation in Water-Storage and "Superconductivity" in Water Transport

In storing electricity, insulation is a self-evident consideration; a battery that leaks has little market value. In storing water, little consideration is given to insulating the reservoir. Water in open reservoirs is exposed to wind and sun where evaporation is facilitated, if not maximized.

In transporting electricity, the resistance is minimized to decrease energy attrition; the research superconductivity is aimed at finding a material which can conduct electricity with a minimum loss of electric energy during transport. In transporting water, little consideration has been given to the minimization of water loss or "superductivity"during transit.

Water-conservation has not been much practiced because water has been a cheap commodity. With the population of the arid regions, as well as the overpopulation of urban areas in humid regions, the cost of water-consumption can no longer be ignored in every instance. The patented invention is designed, inter alia, to minimize the evaporative loss during water transport and water storage.

The invention makes use of another physical principle, that the movement of water in a partially saturated zone is a different physical process from the movement of water in a saturated zone.

Water in soil or sediment near the ground surface normally evaporates during the day until the ground surface is heated. The evaporation is greatest in hot regions, and most severe in windy deserts. Solar energy warms the water in the pore space of soil or sediment and wind moves ever more dry air which keeps the humidity from being saturated. Depleted by evaporative loss, the pore space in soil or sediment would be completely filled by air if the evaporated water is not replaced by water from below.

Water in the saturated zone, according to Darcy's Law, cannot rise under its hydrologic potential above the groundwater-table, because the groundwater table is defined by the surface of the greatest height to which underground water in a saturated zone will move. Water in the unsaturated zone above the groundwater table does not move according to Darcy's Law; water in the pore-space of porous medium in the unsaturated zone moves according to the law of capillary pressure.

Where the soil or sediment consists of clay or very fine silt, the diameter of the pore between mineral grains is very, very small; smaller than micrometers, or microns. The small connecting pores in soil or sediment act like tortuous capillary tubes. The capillary force of the "tortuous capillary tubes" will draw up the water from a depth beneath the groundwater table, like water being sucked into a capillary tube. The finer the sediment or soil particles, the smaller the capillary and the greater is the capillary pressure and the higher is water sucked up from beneath the groundwater table.

Underground water is lost to the air by evaporation. Wet ground after a rain dries quickly because water in the pore space near the surface is easily evaporated. After the water is lost from evaporation, the near surface layer of sediment-particles in the unsaturated zone acts as a thermal insulator. Water is then sucked up by the capillary pressure into the unsaturated zone, where it is heated up and evaporated. Where there is little or no capillary pressure, water cannot move up toward the surface.

A series of field investigations and laboratory experiments were conducted to study the insulating effect of the unsaturated zone, and the effectiveness of various types of sediments as insulation to prevent evaporative loss. The experiments have shown that rate of water loss from sediment at a depth of a meter is reduced to a few percent of the rate of the water loss at surface. Where the unsaturated zone is a sand or gravel layer more than a meter thick, very little water is lost by evaporation, because the water in the sand or gravel below the groundwater table cannot be sucked up to replace the water evaporated in the unsaturated zone. The evaporative loss of water from the unsaturated zone of clay or mud sediment is much greater, the strong capillary force effectively sucks up water from the depth of the zone to replace water loss at surface by evaporation.

The results of the investigations led to the discovery that evaporative loss from a water-bearing porous medium can be reduced to a minimum or eliminated if the medium is covered by an insulating layer of a certain thickness, commonly less than 1 meter thick, of debris which has no capillary ability to suck up water from below. In other words, water can be stored in a porous medium with 40% of the volume filled and be insulated by a layer of coarse sand or gravel.

The idea that the evaporative rate of water in a reservoir can be changed by use of a cover layer of porous material has been suggested by S. A. Jack (U.S. Pat. No. 4,039,451). Jack suggested that waste-water evaporation can be accelerated by including an upper layer of rock pieces above a water-bearing porous medium. That invention makes use of the fact that the upper layer of rock pieces can be quickly heated up, so that the waste-water can also be quickly heated, causing an acceleration of the evaporation of the waste water. In using an insulating layer of a porous medium such as a layer of rock pieces above a water-bearing storage body, the thickness of the layer has to be such that the water-level (i.e. the groundwater table) used in the storage of the porous medium is sufficiently deeper, so that the water in the storage body is not heated. The absence of a capillary force in the "layer of rock pieces" will prevent the rise of the water to a shallow depth, where it could be heated and quickly evaporated. Our invention serves exactly the opposite purpose as that by Jack: the rate of evaporation is minimized not increased by including an upper layer of rock pieces.

DETAILED DESCRIPTION OF THE INVENTION

Making use of the knowledge that the water in porous medium flows according to Darcy's Law and our discovery that coarse debris could serve as an insulation against evaporative loss from a water-bearing porous medium, the invention describes:

(1) a method for modifying a natural drainage system as an integrated hydrologic circuit for water-storage and transport;

(2) a method for constructing irrigation facilities for land-reclamation and agriculture, (3) a method of constructing water-storage facilities for urban consumption.

Instead of reservoir lakes, or cisterns, we propose to store water in a layer of coarse sediment such as sand, gravel, or other coarse debris.

Valley Stream Deposit as a Natural Water-Storage and Water-Transport in Porous Medium Aside from evaporative loss to the air, water loss in nature takes place when water flows into the ocean as surface runoffs. Water from springs or falling rain will flow into depressions. Water is drained as surface flow in the form of streams. The groundwater table in a sediment-filled stream-valley is at about the same level as the surface of the stream. Where a stream is deeply cut into a valley, the water table is a number of meters down. The porous medium of stream sand and gravel is thus filled with air. This situation can be corrected by damming the stream flow so that the storage volume of the stream can be increased substantially.

The common practiced of minimizing the water loss as surface runoffs is to build dams so that the water can be stored in reservoir lakes. The disadvantages of the practice are twofold:

1) the engineering cost of building high dams
2) the enlargement of the surface of exposure in a reservoir lake to evaporation.

The present invention makes use of the principle that water can be store in a porous medium. The engineering cost of building small retaining structures or partitions between segments of streams is much less than that of building high dams. Furthermore the water is stored as ground water in a porous medium so that the evaporative loss is practically nil.

Since loose debris has 40% porosity, water is stored in the 40% pore space of the loose debris. Therefore, water-reservoirs, especially in arid regions, need not be a reservoir-lake, but a body of loose debris behind a partition built across a stream. Stream sand and gravel is a natural water-reservoir, the ground water table can be adjusted by a consideration of Darcy's Law of groundwater flow. The unsaturated zone of the stream deposit is made sufficiently thick to provide effective insulation, but not so thick that enough water cannot be stored. Water can flow under its own potential as groundwater into well(s), or into a water-tower for urban consumption in areas where water-supply is needed, or for irrigation in arid regions.

Water in a storage or transport-conduit can be lost in the form of seepage underground, because the groundwater-table can be at a considerable depth beneath the surface. Normally, precipitation falling on desert ground penetrates through an unsaturated zone to recharge the groundwater at a depth. The integrated hydrologic circuits in regions where the groundwater table is relative deep has to be insulated at a depth against seepage, using various currently patented device. The advantage of using natural drainage such as streams lies in the fact that stream deposits commonly overlie a relatively impermeable rock bottom.

The only patents relevant to water in a river-bed are J09047605 and J08260553. The former discloses an invention of introducing river water into a tank buried in bottom of river where fish are grown. The latter is a device to prevent soil pollution due to absence of underground water. Neither invention is relevant to the process disclosed by this application of stream-management for water storage and water-transport.

Construction of Irrigation Facilities for Land Reclamation and Agriculture

The conduits for water transports are commonly irrigation canals, designed according to Chazy's Equation of open channel flow. The flow is driven by gravity, and much of the water is lost during transport by evaporation. Water to be transported underground in a porous medium has two advantages: 1) water can be induced to flow in a sealed porous medium uphill under a hydrologic head at the source, and 2) the evaporative loss during transport is reduced to a minimum.

In constructing transporting conduits for water to flow in a porous medium under the hydrologic head at the source, a sloping upward channel can be sealed on its upper side to save the energy of pumping the water of an open channel upward. The sealing could be very fine-grained sediment, stones or cement plates, or other material. The sealing layer at the same time serves as the insulation against evaporative loss.

The water flowing as a groundwater in porous medium is relatively slow. Darcy's Law has to be applied to calculate a steady state of transport so that enough water can be supplied from the source for uses at the other end.

Constructed Water Storage for Urban Consumption

Means other than sand or gravel can be used to minimize the evaporative loss from soil, i.e., by paving the top of a water-bearing porous medium with another porous medium, or with stone plates, cement, and/or other insulation material. Pits filled by a porous medium, such as sand, gravel, or plastics, could be constructed to store rainwater for daily use.

A self-sufficient water-storage reservoir for household consumption is particularly useful in rural areas not yet connected to urban water-works. Sand or gravel has a capacity to store a water volume of 40% of the sediment volume. A sand-filled volume of 250 $m^3$, or a sand pit 1 m. deep in an area of 12.5×20 m area, for example, can store 100 $m^3$ of water between rainfalls. Where the rainfalls are not infrequent, or where the storage is recharged every one or two weeks, the porous medium can be a medium or coarse-grained sand, and the volume of the water stored is sufficient for the normal consumption of one or more families. Such a small sand pit could be covered by a layer of porous medium, by a patio, by a garden lawn, etc. Rainwater from the roof or parts of the surrounding ground can be collected to feed into the "cistern" filled with a porous medium.

The water stored in a porous medium can be drained into a well from which it is transported via conduits, to be described in the examples, to supply the horticulture uses in the gardens, and the daily domestic uses at home. For urban consumption, architects could design "cisterns" of a size to store sufficient water for consumption between rainfalls. Deficit water could be purchased from the city.

Large building grounds like factories, schools, commercial buildings could build large storage areas, filled by a porous medium, for horticultural use and for daily consumption. A sand-filled volume of 25,000 $m^3$, i.e., a sand pit 1 m. deep in an area of 125×200 m, for example, can store 10,000 $m^3$ of water between rainfalls. Such a large sand pit could be excavated and covered under a football field, a court yard, a parking lot, etc. Rainwater from the roof or parts of the surrounding ground can be collected to feed into the sand-filled "cistern." Water from the cistern could be supplied to a transport-circuit for horticulture.

The idea that a sports ground or other green areas should be underlained by a porous underground has been patented (GB 2001512, FR 2682410, FR 2604737, EP770735, WO 9307345/FR 2682410, DE 2727956/GB 2001512, P-30480/PT-71556, U.S. Pat. No. 3,685,298). All those patented processes emphasize the use of porous medium not so much as a leak-proof storage facility, but for drainage purpose. Also they did not consider the use of a porous medium with no capillary force as an insulation for the water-storage facility.

Ideally, a circuit can be so designed, according to examples described by this patent, that water for the growth of plants and vegetations in an orchard, a field, or a garden can be directly supplied by a shallow artificial aquifer. With such a system, not only the cost of water is a part of the saving, the construction of a system delivering water to the fields, to green areas, and to orchards or gardens will also save the labor cost of agricultural production or of maintaining the landscaping of large building complexes.

DESCRIPTION OF EXAMPLES

1) Construction of Partitions Across Stream Valleys for Water-Storage

Figure 3:
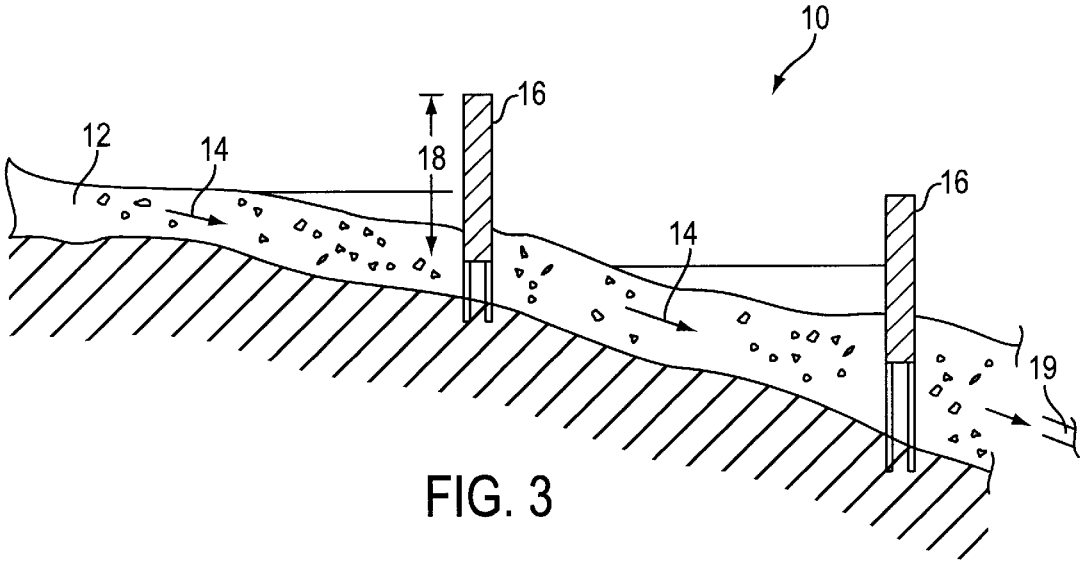
FIG. 3 is an example of a construction of barriers across a stream valley for the storage and transport of water in accordance with the method of the invention.
Figure 4:
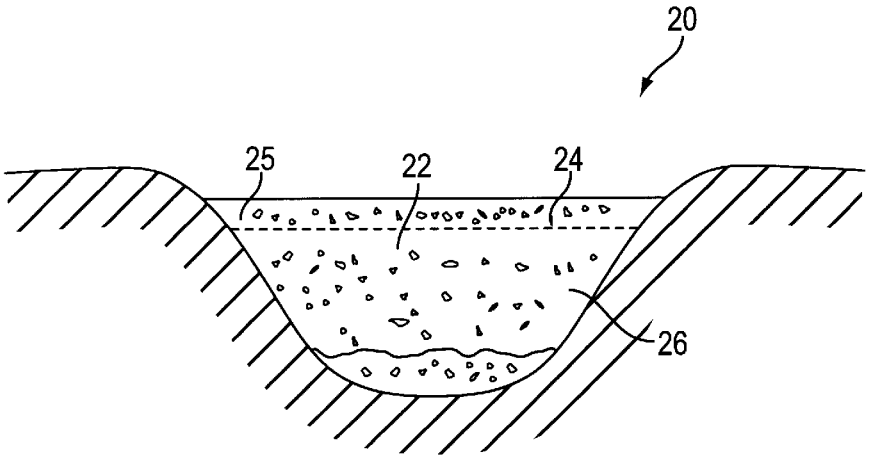
FIG. 4 is an example of the use of porous material in a stream channel for the storage and transport of water in accordance with the method of the invention.

Stream valleys 10 (see FIG. 3) are considerably wider than a stream channel 20 (see FIG. 4). The valleys are underlain by loose, unconsolidated debris, mostly sand and gravel 12. The flowing water 14 is restricted to the narrow channel. The groundwater table of the stream-valley sediment is at about the same level as the water-level in the channel. Where a stream valley is relatively deeply cut, the bulk of the valley sediments is situated above the water table. Thus water stored in the sand and gravel of a stream valley is relatively small.

Where a barrier 16 (see FIG. 3) is built across the valley, as it is often done for flood-control in regions of high relief, the flow of the water is dammed. The loose debris is filled to the brim behind the barrier, and the pore space of the debris is filled by water. A barrier constructed for flood control serves thus the same function of a dam to store water behind the barrier. Where the barrier is breached by a drain to facilitate the surface flow of the stream, the groundwater level in the porous medium behind the barrier is correspondingly lowered, and thus the water-storage capacity is impaired. The barriers built to increase the storage-facility of stream deposit should thus be built to a height to maximize the storage-capacity by the porous medium.

High dams are built to accentuate the height different of the water level behind and in front of the dam, for the sake of an increase of the potential energy of water flow to generating electricity. The cost of dam construction is very high. The purpose of constructing barriers or partitions 16 across stream valley in an IHC is to store water in porous medium, not to generate electricity. There is no need to construct high dams, and the cost of construction can thus be greatly saved. In fact, the partitions need not as strongly anchored to the valley bottom in stream valleys of low gradient as a dam. The partitions serve the function of raising the groundwater table in the valley sediment and thus to increase the water-storage capacity of the sediment behind the barrier. The engineering design of the barriers should thus be specially tailored to suit the local conditions.

One or more barriers 16 can be constructed over the whole length of a stream valley. The partitions are punctuated by pipes with coarse gravel, so that the water could flow from the storage from one segment of a stream behind a barrier to the storage forward of a barrier. The height 18 of barriers is designed according to the desired volume of water storage. The total storage volume of the stream-sediment is calculated on the basis of (1) demand of water consumption;

(2) thickness of stream deposit in the valley;

(3) quantity of maximum precipitation;

(4) frequency of rainfall, large or small.

Higher barriers are needed for great storage-volume, especially in more arid areas of great need and flash floods. Lower barriers or partitions are favored where cost-saving can be the first priority.

Precipitation from an unusual thunderstorm is not likely to be entirely stored in a water-storage behind a barrier. Spillways to remove the excess floodwater to emergency reservoirs need to be constructed, both for water conservation and for preventing damage to the system of construction.

In regions of large relief and considerable rainfall such as Taiwan, systems could be designed to fulfill the needs of urban consumption and rural irrigation. A watertower can be constructed, and groundwater in the valley sediment may have enough hydrologic potential to flow into the watertower, from there to be distributed for urban use. For rural use, an irrigation system with debris filled channels could be designed, as described in the next section.

2) Water-Conservation in Irrigation in Semi-Arid and Arid Regions

Efforts to turn a desert green through irrigation are limited by the available precipitation. Not only an arid land like Israel, but even countries in humid regions like China are utilizing more than 90% of their precipitation for irrigation. Water used for irrigation is largely lost by evaporation, and the amount of water actually taken up by the plant is relatively small compared to the total volume of the irrigation water.

Nature has its waterways in deserts as underground rivers. The Mojave River, for example, is dry, but water flows from one part of the Mojave Desert to another in the river-sediment as a stream of groundwater. In arid regions where water is scarce and where evaporative loss of open water-bodies is considerable, irrigation canals should not be constructed as open channels, but channels 20 (see, for example, FIG. 4), filled with coarse sand and/or gravel, 22 so as to minimize evaporative loss of the water flowing through the porous medium 22. The flow rate is reduced, of course, and the necessary flow rate should be calculated, according to Darcy's Law, to meet demand.

Orchards requiring irrigation may be sited on inclined slopes or on very flat land. Two different designs of irrigation network have been used—the helminthoid type and the paleodictyn type, for those two different circumstances. The two designs are necessary to provide a water-flow rate through the irrigating network 19 (see FIG. 3 and FIGS. 1–2 which are illustrative of such networks) which is neither too slow nor too fast. Water movement in porous medium is governed by Darcy's Law.

Figure 1:
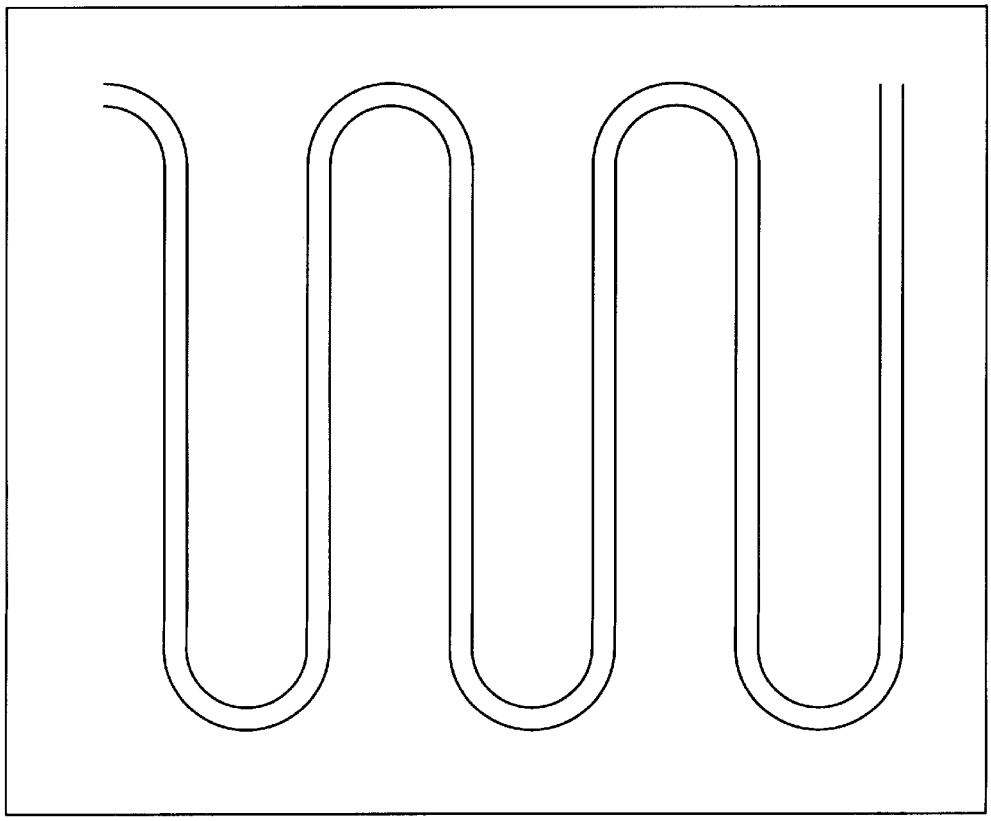
FIG. 1 is the so-called helminthoid network of a hydrologic circuit. It is to be used where the ground surface is inclined. This network of channels is arranged like a boustrophously plowed fields. The channel of porous medium for water transport is constructed to turn back and forth, so that the gradient of groundwater flow in the channel can be rendered relatively small on a relatively steep slope.

Helminthoid is the name given to a kind of animal trails on muddy bottom. The helminthoid type of network is illustrated by FIG. 1. To construct a helminthoid network, channels filled with a porous medium are dug parallel to the topographic contour in a back and forth, like a field plowed in a boustrophous fashion. Arranged in such a fashion, the flow path is greatly lengthened to make the hydrodynamic gradient sufficiently slow for a steady state flow through the network. Water for irrigation is fed in at one end, which is considerably more elevated than the other end. Groves of fruit or nut trees are planted in the partitions between the channels. Water is fed into the sand in the channels, and from there by the capillary action of the soil to the tree roots. Through the back-and-forth path of movement, water is to move slowly enough, as calculated, to replace the optimum utilization of water for plant-growth.

Figure 2:
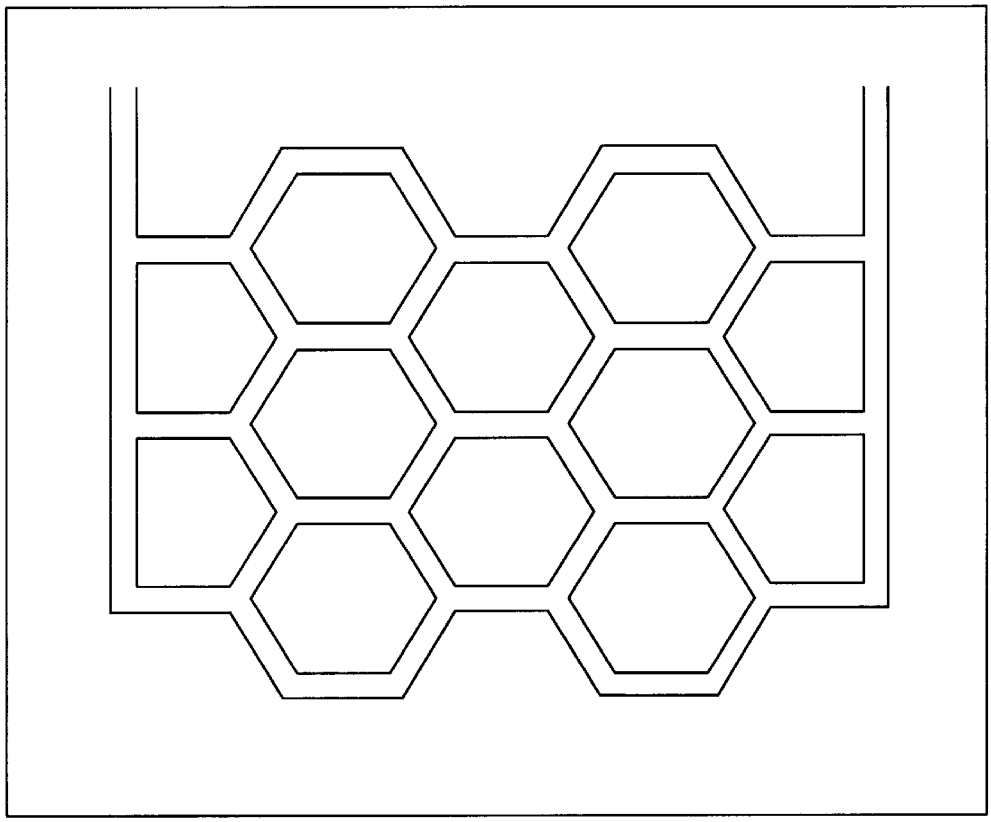
FIG. 2 is the so-called paleodictyn network of a hydrologic circuit. It is to be used where the ground surface is flat. This network of channels has a honey-combed shaped. The channels of porous medium are so constructed so that the gradient of the groundwater flow in the network can be maximized on a relatively flat land.

Paleodictyn is another kind of animal trail on muddy bottom. The paleodictyn type of network is illustrated by FIG. 2. To construct a peleodictyn network, hexagonal channels filled with a porous medium are dug into a flat land. Irrigating water is feeding in at one end, which is slightly higher than the other end, according to a calculation on the basis of the Darcy's Law for steady-state flow. Fruit or nut trees are planted in the middle of the hexagons. Water is fed into the sand in the channels, and from there by the capillary action of the soil to the tree roots. The water movement through the honey-combed network on a flat-bottom is fast enough, as calculated, to replace the optimum utilization of plant-growth.

As shown, for example, in FIG. 4, the thickness of the unsaturated zone 25, i.e., the water level in the sand-filled channels, can be so adjusted so that the evaporative loss of water in the saturated zone 26 can be minimal. When trees are big and their roots deep, the groundwater-level 24 in the channels can be adjusted to lie considerably below the ground surface, so that the rather thick unsaturated zone 25 hinders the water loss. When trees are newly planted and when the roots are not deep enough, the groundwater table in the channels has to be closer to the ground surface, even if there would be more evaporative loss of water. If reduction of water loss from the soil between the channels is desirable, a thin layer of coarse debris can be placed between trees. Sand or gravel can also be placed in sacks so as to be used elsewhere when such insulation is no longer necessary.

At times of rainfall, water could be overflowing the sand channels of the network. The surplus rainwater should be channeled to water reservoirs to be used later for irrigation. Instead of reservoir ponds or lakes, one should use a natural sand deposit to store the surplus rainfall. The sand deposit can be that deposited in the stream, or may be constructed as an artificial, debris-filled, water-storage.

(3) Water and Labor Conservation in Landscaping

In humid countries like North America and Europe, rainfall is plentiful for lawns and vegetable gardens at home or for crops in the fields. Temporary storage-facilities of water renders the possibility of a full use of annual precipitation.

Cisterns with water store in porous medium as heretofore described could be constructed under lawns, sport grounds, terraces, parking lots, etc. and water is transported via hydrologic circuit to a system water-storing aquifer under a lawn or traversing a flower garden, an orchard, or a field of vegetables or crops.

The conduit system consists of main trunks for transport and distributary channels for distribution. Where plants are to grow over an entire area, as grass in a lawn, an aquifer, x cm thick, is constructed, under a thin cover of soil y cm thick. Where rows of vegetables or trees are to be planted, the conduit system can be a paleodictyn (honeycomb) or a helminthoid (boustrophous) system, as shown by FIGS. 1 and 2.

With the installation of adequate hydrologic head to transport water from the "cistern" to the aquifer (under a lawn for example), or to a conduit system (traversing a flower bed for example). The system may have to be sealed at the bottom so that the aquifer and/or conduit could be permanently water-saturated. With such a system, water is always available to a plant, and there is no need to water the plant. There will be not only the saving of the cost of water, but also a saving of the labor cost.

What is claimed is:

1. A method for providing storage and transportation for water such as natural precipitation collected from a large area comprising the steps of:

erecting a barrier across a stream valley, said stream valley being underlain by a porous medium having a storage capacity, calculating the barrier height to optimize said storage capacity of said porous medium and having associated therewith a flow rate adjusted according to Darcy's Law to insure a steady motion of water flow through said porous medium, moving water through said porous medium of said stream valley under a hydrologic potential with minimum evaporative loss attributable to said porous medium, and moving the water to a network where the water can be directly supplied to end users.

2. A method for providing storage and transportation for water such as natural precipitation collected from a large area, comprising the steps of:

moving water under a hydrologic potential through a natural channel of stream bed, said bed having a porous deposit filled with water to a height wherein its unsaturated zone serves as an insulator of the hydrologic conduit to minimize loss of water in the saturated zone by evaporation during storage or transport, and moving the water through a network where the water can be directly supplied to end users.

* * * * *